US006667275B2

(12) United States Patent
Sano et al.

(10) Patent No.: US 6,667,275 B2
(45) Date of Patent: Dec. 23, 2003

(54) HEAT-SENSITIVE RECORDING MATERIAL

(75) Inventors: Shojiro Sano, Shizuoka-ken (JP); Fumiya Tabata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 78 days.

(21) Appl. No.: 09/987,081

(22) Filed: Nov. 13, 2001

(65) Prior Publication Data

US 2002/0091065 A1 Jul. 11, 2002

(30) Foreign Application Priority Data

Nov. 13, 2000 (JP) ..... 2000-345630
Apr. 9, 2001 (JP) ..... 2001-110050

(51) Int. Cl.[7] ..... B41M 5/40
(52) U.S. Cl. ..... 503/200; 503/226
(58) Field of Search ..... 503/200, 226

(56) References Cited

U.S. PATENT DOCUMENTS 4,762,816 A * 8/1988 Tamagawa et al. ..... 503/200

FOREIGN PATENT DOCUMENTS

JP 08-282112 10/1996

* cited by examiner

*Primary Examiner*—B. Hamilton Hess
(74) *Attorney, Agent, or Firm*—Sughrue Mion, PLLC

(57) ABSTRACT

The present invention provides a high-quality heat-sensitive recording material which can prevent curling attributed to an environmental change or heating during recording, is free of deformation of the material, and is applicable to a wide variety of fields. The heat-sensitive recording material of the present invention has at least a heat-sensitive recording layer on one side of a support and a back coat layer on the other side, wherein the back coat layer comprises a plurality of layers, and the outermost layer in the back coat layer most remote from the support contains an inorganic lamellar compound and/or polyvinyl alcohol. The inorganic lamellar compound is preferably water-swelling synthetic mica.

19 Claims, No Drawings

HEAT-SENSITIVE RECORDING MATERIAL

BACKGROUND OF THE INVENTION

1. Field of the Invention

The present invention relates to a heat-sensitive recording material and in particular to a heat-sensitive recording material excellent in curling resistance.

2. Description of the Related Art

A heat-sensitive recording material for recording images by applying heat using a thermal head, etc. is relatively inexpensive, and a recording device for the heat-sensitive recording material is simple, highly reliable and maintenance-free. Accordingly, the heat-sensitive recording material is widely used, and in recent years, high performance characteristics such as high image quality and image storability have been achieved.

On the other hand, the heat-sensitive recording material subjected to a change in environmental humidity or to heating during recording has a problem of losing balance in elongation between a front face and a back face of the heat-sensitive recording material and is thus deformed toward one side, resulting in a problem in qualities called curling. This problem has been observed particularly significantly in a multi-layer multicolor heat-sensitive recording material wherein a plurality of heat-sensitive recording layers exhibiting different color hues have been laminated.

Such curling impairs the qualities of the recording material as a product even if higher performance could be achieved in image quality and image storability.

To prevent such curling, the heat-sensitive recording material is provided not only with a heat-sensitive recording layer, a protective layer, etc. but also with a back coat layer on an opposite side (back) of a support, on which the heat-sensitive recording layer and the like are not arranged. For example, JP-A No.8-282112 discloses a heat-sensitive recording material provided with a back coat layer consisting of a single layer on a support, wherein the layer comprises an inorganic lamellar compound. By providing the recording material with the inorganic lamellar compound-containing layer on the other side of the support than the side having the heat-sensitive recording layer, it is certainly possible to prevent curling of the recording material to some degrees. However, in a low-humidity environment, curling cannot be completely prevented, whereby deformation in a curled state occurs, thus deteriorating the qualities of the heat-sensitive recording material. A multicolor heat-sensitive recording material having a thick recording layer consisting of plural layers is also easily curled, and hence encounters a problem with maintaining flatness.

In recent years, various techniques of forming images have been provided. Although coloration of images is advancing and regarded as important, the ability of the material itself to be stable as a recording medium without deterioration in qualities is required along with improvements in performance such as high image quality and image storability. Again because of curling, the range of applications of a material may be limited.

As described above, a heat-sensitive recording material which is capable of preventing curling attributable to a change in environmental humidity during use or to heating during recording, free of deterioration in qualities resulting from deformation of the material, and applicable to a wide variety of fields has not yet been provided.

SUMMARY OF THE INVENTION

To solve various problems in the prior art described above, an object of the present invention is to achieve the following goal. That is, the object of the present invention is to provide a high-quality multicolor heat-sensitive recording material formed of a sheet material or multiple layers or the like, which can prevent curling attributable to an environmental change or heating during recording, is free of deformation of the material, and is applicable to a wide variety of fields.

The means to achieve the object are described as follows:

A mode of the present invention is a heat-sensitive recording material having at least a heat-sensitive recording layer on one side of a support and a back coat layer on the other side, wherein the back coat layer comprises a plurality of layers, and an outermost layer in the back coat layer, which is most remote from the support, contains an inorganic lamellar compound or polyvinyl alcohol.

Another mode of the present invention is a heat-sensitive recording material having at least a heat-sensitive recording layer on one side of a support and a back coat layer on the other side, wherein the back coat layer comprises a plurality of layers, and an outermost layer in the back coat layer, which is most remote from the support, contains an inorganic lamellar compound. It is preferable that the outermost layer further contains gelatin, and it is more preferable that the inorganic lamellar compound is a synthetic mica.

Still another mode of the present invention is a heat-sensitive recording material having at least a heat-sensitive recording layer on one side of a support and a back coat layer on the other side, wherein the back coat layer comprises a plurality of layers, and an outermost layer in the back coat layer, which is most remote from the support, contains polyvinyl alcohol. It is preferable that the outermost layer further contains an inorganic lamellar compound, and it is more preferable that the layer positioned between the outermost layer and the support contains gelatin.

DESCRIPTION OF THE PREFERRED EMBODIMENTS

The heat-sensitive recording material of the present invention has a back coat layer consisting of multiple layers on a surface of a support on which a heat-sensitive recording layer is not provided. An outermost layer in the back coat layer, which is most remote from the support, contains an inorganic lamellar compound and/or polyvinyl alcohol.

Hereinafter, the heat-sensitive recording material of the present invention is described in detail. Polyvinyl alcohols as used herein refer to polyvinyl alcohols and/or modified polyvinyl alcohols.

The heat-sensitive recording material of the present invention has at least a heat-sensitive recording layer on one side of a support, which may consist of a single or plural layers and may have other layers such as a protective layer as necessary, and on the other side of the support, may have a back coat layer consisting of plural layers and if necessary additional layers.

(Back Coat Layer)

The back coat layer is formed by laminating two or more layers, and consists of the outermost layer (hereinafter, also called "outermost back layer") most remote from the support and one or more layers (hereinafter, also called "intermediate back layers") positioned between the outermost layer and the support.

<Outermost Back Layer>

The outermost back layer contains an inorganic lamellar compound and/or polyvinyl alcohol which serves as a binder, and as necessary additional components.

For example, in an environment with extreme low or high humidity, water in a vapor form is easily released from, or absorbed into, the layer in contact with air. In this case, when water absorption and release is different between the two sides of the support, shrinkage balance is lost, which facilitates curling to occur on one side. Especially in a multicolor heat-sensitive recording material consisting of plural layers, water absorption and release are significantly different between the side having the multi-layered heat-sensitive recording layer and the side not having the layer, and thus shrinkage balance is further lost, which causes serious deformation. However, when the side (back face) not having the heat-sensitive recording layer is provided with a back coat layer consisting of plural layers and the outermost layer thereof contains an inorganic lamellar compound or polyvinyl alcohol, water retained in a layer adjacent to the outermost layer can be blocked by the outermost layer, whereby migration of water across layers upon a change in air humidity can be inhibited and thus the balance in shrinkage between the front and the back can be easily maintained. Further, although water migration is easily facilitated during thermal recording, the balance in shrinkage between the front and the back during heat application can be maintained.

As the polyvinyl alcohol, polyvinyl alcohol and/or modified polyvinyl alcohol are used. From the standpoint of preventing curling, a degree of saponification thereof is preferably 88% or more, more preferably 97% or more.

Examples of modified polyvinyl alcohols include carbonyl-modified polyvinyl alcohol, carboxy-modified polyvinyl alcohol, silanol-modified polyvinyl alcohol, ethylene-modified polyvinyl alcohol, etc.

The amount of the polyvinyl alcohol applied for coating onto the outermost back layer is preferably 0.3 to 5.3 g/m$^2$. When the amount applied is specified within this range, preferable curling properties can be achieved.

Examples of inorganic lamellar compounds include:

a mica group represented by the general formula (1):

$$A(B, C)_{2-3}D_4O_{10}(OH, F, O)_2 \quad (1)$$

wherein A represents K, Na or Ca, B and C each independently represents Fe (II), Fe (III), Mn, Al, Mg or V, and D represents Si or Al; and talcum, represented by $3MgO.4SiO_2.H_2O$, as well as taeniolite, montmorillonite, saponite, hectorite, zirconium phosphate and so on.

In the mica group represented by the general formula (1) above, natural micas include, e.g., common mica, paragonite, phlogopite, biotite and lepidolite. Synthetic micas include non-swelling micas such as phlogopite fluoride $KMg_3(AlSi_3O_{10})F_2$, potassium tetrasilicate mica $KMg_{2.5}(Si_4O_{10})F_2$, etc., as well as swelling micas such as Na tetracyclic mica $NaMg_{2.5}(Si_4O_{10})F_2$, Na or Li taeniolite $(Na, Li)Mg_2Li(Si_4O_{10}O)F_2$, montmorillonite type Na or Li hectorite $(Na, Li)_{1/3}Mg_{2/3}Li_{1/3}(Si_4O_{10})F_2$, etc. Further, synthetic smectites are also useful.

Among these lamellar compounds, water-swelling synthetic mica is preferably used in the present invention, and swelling fluorine type synthetic mica is particularly preferable.

The aspect ratio of the inorganic lamellar compound is preferably 20 or more, more preferably 100 or more, and most preferably 200 or more. The aspect ratio is a ratio of thickness to a longer diameter of the particles of lamellar compound. If the aspect ratio is less than 100, water migration across the layers cannot be blocked and curling cannot be effectively prevented, while if the aspect ratio is 200 or more, the effect of preventing curling is significant.

A possible reason that the heat-sensitive recording material can be prevented from being curled by incorporation of the inorganic lamellar compound having a large aspect ratio is that the elasticity modulus and the strength of the layer are increased while the thermal expansion coefficient and the mold shrinkage factor become lowered and isotropic in two dimensions.

The diameter of the inorganic lamellar compound, in terms of average longer diameter, is preferably 0.3 to 20 $\mu$m, more preferably 0.5 to 10 $\mu$m and most preferably 1 to 5 $\mu$m.

The average thickness of the lamellar compound is preferably 0.1 $\mu$m or less, more preferably 0.05 $\mu$m or less and most preferably 0.01 $\mu$m or less.

When polyvinyl alcohol is contained in the outermost layer, content of the inorganic lamellar compound in the outermost back layer is preferably 3 to 30 parts by mass, more preferably 5 to 20 parts by mass, relative to 100 parts by mass of polyvinyl alcohol. When gelatin as described later is used in the additional components in the outermost back layer, the amount of the inorganic lamellar compound contained is 1 to 100 parts by mass, more preferably 5 to 30 parts by mass, relative to 100 parts by mass of gelatin.

When the amount of the inorganic lamellar compound is specified within the above range, the balance in shrinkage between the front and the back of the heat-sensitive recording material can be maintained, curling can be sufficiently prevented, and processability such as coating properties can be improved.

When polyvinyl alcohol is used as a binder in the outermost back layer, the ratio of the inorganic lamellar compound (x) to the binder (y) to be included (mass ratio: x/y) is preferably from 3/100 to 20/100. When the water-soluble binder described later is contained in the outermost layer, the ratio of the lamellar compound (x) to the binder (y) to be included (mass ratio: x/y) is preferably from 1/100 to 55/100.

When the ratio is specified within the above range, the balance in shrinkage between the front and the back of the heat-sensitive recording material can be maintained, and curling can be sufficiently prevented.

Even when plural kinds of inorganic lamellar compounds are used, the total amount thereof is preferably in the above mass ratio range.

—Additional Components—

The outermost back layer may contain a water-soluble binder.

The water-soluble binder can be formed by using, e.g., water-soluble polymers such as vinyl acetate/acrylamide copolymers, silicon-modified polyvinyl alcohol, starch, modified starch, methyl cellulose, carboxymethyl cellulose, hydroxymethyl cellulose, gelatins, gum arabic, casein, styrene/maleic acid copolymer hydrolyzates, styrene/maleic acid copolymer half-ester hydrolyzates, isobutylene/maleic anhydride copolymer hydrolyzates, polyacrylamide derivatives, polyvinyl pyrrolidone, sodium polystyrene sulfonate, and sodium alginate, as well as water-insoluble polymers such as styrene-butadiene rubber latex, acrylonitrile-butadiene rubber latex, methyl acrylate-butadiene rubber latex, and vinyl acetate emulsion.

Among the water-soluble binders described above, gelatins are preferable. It is particularly preferable to use gelatins such as alkali-preferable. It is particularly preferable to use gelatins such as alkali-treated gelatin having a low isoelectric point, gelatin derivatives (e.g., phthalated gelatin) in which amino groups undergo reaction, etc.

In the outermost back layer, the amount of the water-soluble binder applied is preferably 0.2 to 4 g/m$^2$. When its amount is specified within this range, preferable curling properties can be obtained.

From the standpoint of achieving smooth movement, etc. of the material during recording, the outermost back layer may contain a pigment, a metal soap, wax, a waterproofing agent, etc. insofar as the effect of the present invention is not impaired.

Examples of pigments include, but are not limited to, kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microbaloon, urea-formalin fillers, polyester particles, cellulose fillers, etc.

Examples of metal soaps are, e.g., higher fatty acid polyvalent metal salts, and specific examples thereof include zinc stearate, aluminum stearate, calcium stearate, zinc oleate, etc.

The wax used in the present invention may be any one having a melting point of 40 to 120° C., and preferred examples thereof are paraffin wax, polyethylene wax, carnauba wax, microcrystalline wax, candelilla wax, montan wax, fatty acid amide type wax, etc., among which paraffin wax, montan wax, methylol stearoamide, etc. with a melting point of 50 to 100° C. are more preferable.

The amount of the wax contained in the heat-sensitive recording layer is preferably 5 to 200 parts by mass, more preferably 20 to 150 parts by mass, relative to 100 parts by mass of the electron-donating colorless dye.

Typical examples of waterproofing agents include water-soluble initial condensates such as N-methylol urea, N-methylol melamine and urea-formalin, dialdehyde compounds such as glyoxal and glutaraldehyde, inorganic crosslinking agents such as boric acid and borax, and blended heat-treated materials such as those of polyacrylic acid, methyl vinyl ether/maleic acid copolymers, and isobutylene/maleic anhydride copolymers.

From the viewpoint of achieving a uniform layer to be made on the support, a surfactant may be added. Preferable examples of surfactants include, e.g., alkali metal salts of sulfosuccinic acid, fluorine-containing surfactants, etc., and specifically, sodium salts, ammonium salts, and like salts of di-(n-hexyl)sulfosuccinic acid, di-(2-ethylhexyl) sulfosuccinic acid, etc. are preferable, and anionic surfactants are also suitably used.

The thickness of the outermost back layer is preferably 0.3 to 6 $\mu$m, more preferably 0.5 to 3 $\mu$m. When the thickness of the outermost back layer is 0.3 to 6 $\mu$m, the balance in shrinkage between the front and the back of the heat-sensitive recording material can be maintained, and curling can be sufficiently prevented.

<Intermediate Back Layer>

The intermediate back layer contains at least a water-soluble binder and, as necessary, additional components. By providing the intermediate back layer, the shrinkage balance is further improved and curling of the heat-sensitive recording material can be effectively prevented.

Suitable examples of water-soluble binders include those usable in the above outermost back layer. In particular, gelatins are preferably used. The other components include latex, waterproofing agents, etc.

The thickness of the intermediate back layer is preferably 2 to 15 $\mu$m, more preferably 4 to 10 $\mu$m. When the thickness of the intermediate back layer is 2 to 15 $\mu$m, the balance in shrinkage between the front and the back of the heat-sensitive recording material can be maintained sufficiently, and curling can be prevented sufficiently.

The outermost back layer and the intermediate back layer can be formed by preparing coating solutions for forming the outermost back layer and the intermediate back layer (a coating solution for the outermost back layer and a coating solution for the intermediate back layer), respectively, and coating them by, e.g., known coating techniques. In this case, (i) the coating solution for the outermost back layer and the coating solution for the intermediate back layer may be applied simultaneously or (ii) the coating solution for the intermediate back layer may be applied and dried, followed by applying and drying the coating solution for the outermost back layer formed thereon.

The known coating techniques include, e.g., techniques using an air knife coater, a roll coater, a blade coater, a curtain coater, etc.

(Heat-Sensitive Recording Layer)

The heat-sensitive recording layer comprises a coloring component and, as necessary, other components such as a binder, a base, etc. The coloring components include (1) a combination of a diazonium salt compound and a coupler which causes a coupling reaction with the diazonium salt compound to develop color or (2) a combination of an electron-donating dye precursor and an electron-accepting compound which causes a reaction with the electron-donating dye precursor to develop color.

[Diazonium Salt Compounds]

Diazonium salt compounds includes those compounds represented by the formula (2):

$$Ar—N_2^+X^- \quad (2)$$

wherein Ar represents an aromatic moiety, and $X^-$ represents an acid anion.

The diazonium salt compound is a compound that develop color upon heating and causing a coupling reaction with the coupler described below, and decomposes by light. The maximum absorption wavelength of this compound can be controlled by varying the position or type of substituent groups on the Ar moiety.

Suitable examples of salt-forming diazonium compounds include 4-(p-tolylthio)-2,5-dibutoxy benzene diazonium, 4-(4-chlorophenylthio)-2,5-dibutoxy benzene diazonium, 4-(N,N-dimethylamino)benzene diazonium, 4-(N,N-diethylamino)benzene diazonium, 4-(N,N-dipropylamino) benzene diazonium, 4-(N-methyl-N-benzylamino)benzene diazonium, 4-(N,N-dibenzylamino)benzene diazonium, 4-(N-ethyl-N-hydroxyethylamino)benzene diazonium, 4-(N,N-diethylamino)-3-methoxy benzene diazonium, 4-(N,N-dimethylamino)-2-methoxy benzene diazonium, 4-(N-benzoylamino)-2,5-diethoxybenzene diazonium, 4-morpholino-2,5-dibutoxybenzene diazonium, 4-anilinobenzene diazonium, 4-[N-(4-methoxybenzoyl) amino]-2,5-diethoxy benzene diazonium, 4-pyrrolidino-3-ethyl benzene diazonium, 4-[N-(1-methyl-2-(4-methoxyphenoxy)ethyl)-N-hexylamino]-2-hexyloxy benzene diazonium, 4-[N-(2-(4-methoxyphenoxy)ethyl)-N-hexylamino]-2-hexyloxy benzene diazonium, 2-(1-ethylpropyloxy)-4-[di-(di-n-butylaminocarbonylmethyl) amino] benzene diazonium, 2-benzylsulfonyl-4-[N-methyl-N-(2-octanoyloxyethyl)] aminobenzene diazonium, etc.

The maximum absorption wavelength $\lambda_{max}$ of the diazonium salt compound is preferably 450 nm or less, more preferably 290 to 440 nm. When the $\lambda_{max}$ is specified within this range, shelf stability, image-fixing properties when used in combination with the coupler described below, such as image storability, and the hue developing a cyan color can be improved.

It is desirable that the diazonium salt compound contains 12 or more carbon atoms and has 1% or less solubility in water and 5% or more solubility in ethyl acetate.

The diazonium salt compounds may be used alone or in combination thereof depending on the objects of adjusting the hue, etc.

Among the diazonium salt compounds described above, the diazonium salt compounds represented by the following structural formulae (1) to (3) are more preferable in respect of the hue exhibited by a pigment, image storability, and image fixation.

Structural Formula (1)

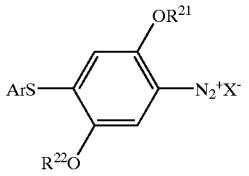

Structural Formula (2)

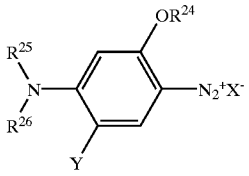

Structural Formula (3)

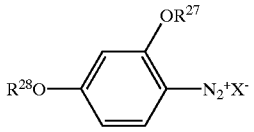

In the above structural formula (1), Ar represents a substituted or unsubstituted aryl group. The substituents include an alkyl group, alkoxy group, alkylthio group, aryl group, aryloxy group, arylthio group, acyl group, alkoxycarbonyl group, carbamoyl group, carbamide group, sulfonyl group, sulfamoyl group, sulfonamide group, ureido group, halogen group, amino group, heterocyclic group, etc., and these substituents may be further substituted.

The aryl group represented by Ar is preferably an aryl group containing 6 to 30 carbon atoms, and examples thereof include a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy) phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3,5-dichlorophenyl group, 3,4-dimethoxyphenyl group, 3-(dibutylaminocarbonylmethoxy)phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonyl phenyl group, 4-ethoxycarbonyl phenyl group, 4-(2-ethylhexylcarbonyl)phenyl group, 4-fluorophenyl group, 3-acetylphenyl group, 2-acetylaminophenyl group, 4-(4-chlorophenylthio)phenyl group, 4-(4-methylphenyl)thio-2,5-butoxyphenyl group, 4-(N-benzyl-N-methylamino)-2-dodecyloxycarbonyl phenyl group, etc. However, preferred examples are not limited thereto in the present invention.

Further, these groups may be further replaced by an alkyloxy group, alkylthio group, substituted phenyl group, cyano group, substituted amino group, halogen atom, heterocyclic group, etc.

In the structural formula (1), $R^{21}$ and $R^{22}$ each independently represents a substituted or unsubstituted alkyl group or a substituted or unsubstituted aryl group. $R^{21}$ and $R^{22}$ may be the same or different.

When $R^{21}$ and $R^{22}$ are substituted, examples of substituents thereon include an alkoxy group, alkoxycarbonyl group, alkylsulfonyl group, substituted amino group, substituted amide group, aryl group, aryloxy group, etc. However, suitable examples are not limited thereto.

An alkyl group represented by $R^{21}$ or $R^{22}$ above is preferably a $C_{1-18}$ alkyl group. Examples thereof include a methyl group, trifluoromethyl group, ethyl group, propyl group, isopropyl group, butyl group, sec-butyl group, t-butyl group, pentyl group, isopentyl group, cyclopentyl group, hexyl group, cyclohexyl group, octyl group, t-octyl group, 2-ethylhexyl group, nonyl group, octadecyl group, benzyl group, 4-methoxybenzyl group, ethoxycarbonyl methyl group, butoxycarbonyl methyl group, 2-ethylhexyloxycarbonyl methyl group, 2',4'-diisopentylphenyloxymethyl group, 2',4'-di-t-butylphenyloxymethyl group, dibenzylaminocarbonyl methyl group, 2,4-di-t-aminophenyloxypropyl group, ethoxycarbonyl propyl group, 1-(2',4'-di-t-aminophenyloxy) propyl group, acetylaminoethyl group, 2-(N,N-dimethylamino)ethyl group, 2-(N,N-diethylamino)propyl group, methanesulfonylaminopropyl group, acetylaminoethyl group, 2-(N,N-dimethylamino)ethyl group, 2-(N,N-diethylamino)propyl group, etc.

The aryl group represented by $R^{21}$ and $R^{22}$ above is preferably a $C_{6-30}$ aryl group. Examples thereof include a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy)phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3,5-dichlorophenyl group, 3,4-dimethoxyphenyl group, 3-(dibutylaminocarbonylmethoxy) phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonyl phenyl group, 4-ethoxycarbonyl phenyl group, 4-(2-ethylhexylcarbonyl)phenyl group, 4-fluorophenyl group, 3-acetylphenyl group, 2-acetylaminophenyl group, 4-(4-chlorophenylthio)phenyl group, 4-(4-methylphenyl)thio-2,5-butoxyphenyl group, 4-(N-benzyl-N-methylamino)-2-dodecyloxycarbonyl phenyl group, etc. However, specific examples are not limited thereto.

These groups may be further replaced by an alkyloxy group, alkylthio group, substituted phenyl group, cyano group, substituted amino group, halogen atom, heterocyclic group, etc.

In the structural formula (2), $R^{24}$, $R^{25}$ and $R^{26}$ each independently represents a substituted or unsubstituted alkyl group or a substituted or unsubstituted aryl group, and $R^{24}$, $R^{25}$ and $R^{26}$ may be the same or different.

When $R^{24}$, $R^{25}$ and $R^{26}$ are substituted, the substituents thereon include, e.g., an alkyl group, alkoxy group, alkylthio group, aryl group, aryloxy group, arylthio group, acyl group, alkoxycarbonyl group, carbamoyl group, carbamide group, sulfonyl group, sulfamoyl group, sulfonamide group, ureido group, halogen atom, amino group, heterocyclic group, etc.

The alkyl group represented by $R^{24}$, $R^{25}$ and $R^{26}$ above is preferably a $C_{1-18}$ alkyl group. Examples thereof include the alkyl groups represented by $R^{21}$ and $R^{22}$ in the structural formula (1), and 1-methyl-2-(4-methoxyphenoxy)ethyl group, di-n-butylaminocarbonyl methyl group, di-n-octylaminocarbonyl methyl group, etc.

The aryl group represented by $R^{24}$, $R^{25}$ and $R^{26}$ above has the same meaning as the aryl group represented by $R^{21}$ and $R^{22}$ in the structural formula (1) above. However, the aryl group is not limited thereto.

These groups may be further replaced by an alkyloxy group, alkylthio group, substituted phenyl group, cyano group, substituted amino group, halogen atom, heterocyclic group, etc.

In the structural formula (2), Y represents a hydrogen atom or $OR^{23}$ group, wherein $R^{23}$ represents a substituted or unsubstituted alkyl group or a substituted or unsubstituted aryl group.

When $R^{23}$ is substituted, the substituents thereon include an alkyl group, alkoxy group, alkylthio group, aryl group, aryloxy group, arylthio group, acyl group, alkoxycarbonyl group, carbamoyl group, carbamide group, sulfonyl group, sulfamoyl group, sulfonamide group, ureido group, halogen atom, amino group, heterocyclic group, etc.

For controlling the hue, it is preferable that Y is a hydrogen atom or an alkyloxy group wherein $R^{23}$ is an alkyl group.

The alkyl group represented by $R^{23}$ above has the same meaning as the alkyl group represented by $R^{21}$ and $R^{22}$ in the structural formula (1) above. However, the aryl group is not limited thereto.

The aryl group represented by $R^{23}$ above has the same meaning as the aryl group represented by $R^{21}$ and $R^{22}$ in the structural formula (1) above. However, the aryl group is not limited thereto. These aryl groups may be further replaced by an alkyloxy group, alkylthio group, substituted phenyl group, cyano group, substituted amino group, halogen atom, heterocyclic group, etc.

In the structural formula (3) above, $R^{27}$ and $R^{28}$ each independently represents a substituted or unsubstituted alkyl group or a substituted or unsubstituted aryl group, and $R^{27}$ and $R^{28}$ may be the same or different.

When $R^{27}$ or $R^{28}$ is substituted, the substituents thereon include, e.g., an alkyl group, alkoxy group, alkylthio group, aryl group, aryloxy group, arylthio group, acyl group, alkoxycarbonyl group, carbamoyl group, carbamide group, sulfonyl group, sulfamoyl group, sulfonamide group, ureido group, halogen atom, amino group, heterocyclic group, etc.

The alkyl group represented by $R^{27}$ and $R^{28}$ above has the same meaning as the alkyl group represented by $R^{21}$ and $R^{22}$ in the structural formula (1) above. However, the alkyl group is not limited thereto.

The aryl group represented by $R^{27}$ and $R^{28}$ above has the same meaning as the aryl group represented by $R^{21}$ and $R^{22}$ in the structural formula (1) above. However, the aryl group is not limited thereto. These aryl groups may be further replaced by an alkyloxy group, alkylthio group, substituted phenyl group, cyano group, substituted amino group, halogen atom, heterocyclic group, etc.

In the structural formulae (1) to (3) shown above, $X^-$ represents an acid anion, and examples of acid anions include $C_{1-9}$ polyfluoroalkyl carboxylic acid, $C_{1-9}$ polyfluoroalkyl sulfonic acid, boron tetrafluoride, tetraphenyl boron, hexafluorophosphoric acid, aromatic carboxylic acid, aromatic sulfonic acid, etc. In particular, hexafluorophosphoric acid is preferable in respect of crystallizability.

Examples of the diazonium salt compounds represented by the structural formulae (1) to (3) above are shown below, but are not limited thereto.

(2)-1

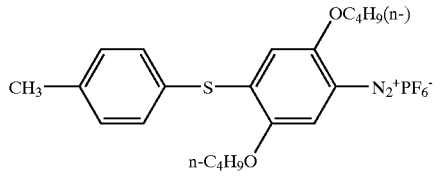

(2)-2

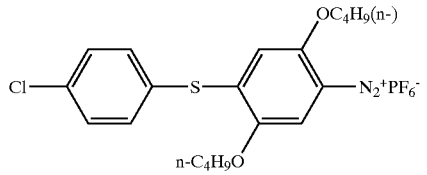

(2)-3

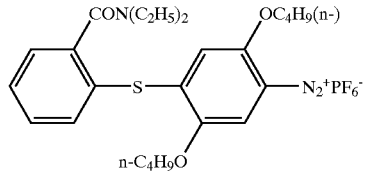

(2)-4

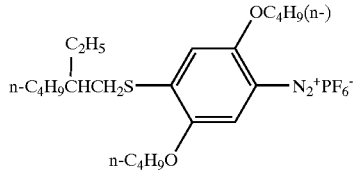

(3)-1

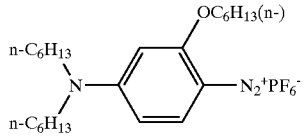

(3)-2

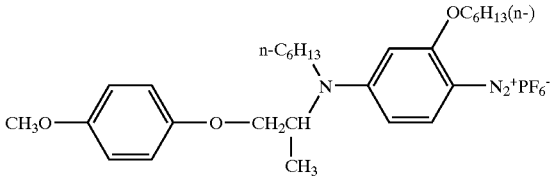

(3)-3

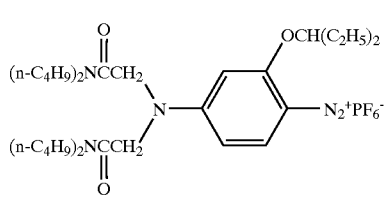

-continued (3)-4

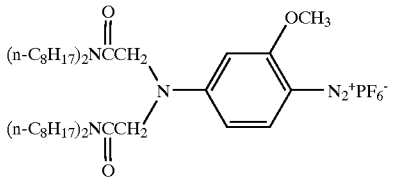

(3)-5

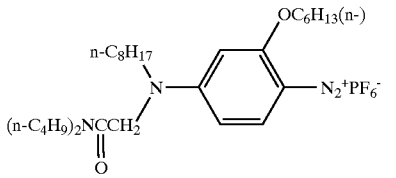

(3)-6

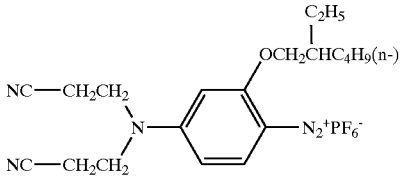

(3)-7

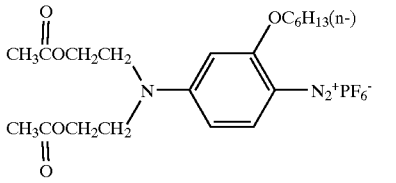

(3)-8

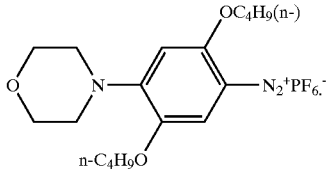

(3)-9

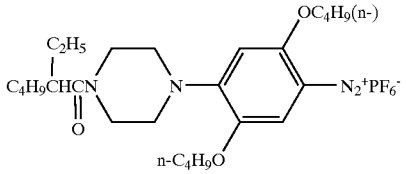

(3)-10

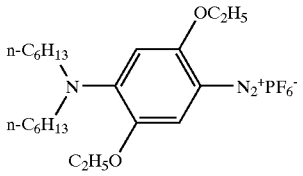

(4)-1

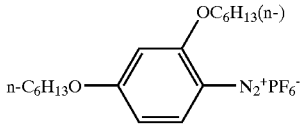

The diazonium salt compounds represented by the structural formulae (1) to (3) above may be used alone or in combination thereof. Depending on various purposes such as the hue control, etc., the diazonium salt compounds represented by the structural formulae (1) to (3) may be used in combination with other existing diazonium salt compounds.

The amount of the diazonium salt compound applied for coating is preferably 0.05 to 2 g/m$^2$, more preferably 0.1 to 1 g/m$^2$, in the heat-sensitive recording layer. When its content is specified within this range, sufficient color density is obtained while the coating suitability of the coating solution can be improved.

[Couplers]

The couplers which can develop color by undergoing a coupling reaction with the diazonium salt compound to form a coloring matter may be any compound capable of coupling with the diazonium salt compound to form a coloring matter in a basic atmosphere and/or a neutral atmosphere.

A so-called tetraequivalent coupler used in silver halide photographic photosensitive materials can be used as the coupler in the present invention and selected suitably so as to satisfy purposes such as obtaining suitable hues. For example, mention can be made of a so-called active methylene compound having a methylene group adjacent to a carbonyl group, phenol derivatives, naphthol derivatives, etc.

In particular, the compounds represented by formula (3) below or tautomers thereof are particularly preferable.

$$E^1—CH_2—E^2 \quad (3)$$

wherein $E^1$ and $E^2$ may be the same or different and each independently represents an electron attractive group.

The electron attractive group refers to a substituent group whose Hammett's σ value is positive, and examples thereof include acyl groups such as an acetyl group, propionyl group, pivaloyl group, chloroacetyl group, trichloroacetyl group, trifluoroacetyl group, 1-methylcyclopropyl carbonyl group, 1-ethylcyclopropyl carbonyl group, 1-benzylcyclopropyl carbonyl group, benzoyl group, 4-methoxybenzoyl group and thenoyl group, alkoxycarbonyl groups such as methoxycarbonyl group, ethoxycarbonyl group, 2-methoxyethoxycarbonyl group and 4-methoxyphenoxycarbonyl group, carbamoyl groups such as carbamoyl group, N,N-dimethylcarbamoyl group, N,N-diethylcarbamoyl group, N-phenylcarbamoyl group, N-[2,4-bis(pentyloxy)phenyl] carbamoyl group, N-[2,4-bis(octyloxy)phenyl] carbamoyl group or morpholinocarbonyl group, alkylsulfonyl groups or arylsulfonyl groups such as a methanesulfonyl group, benzenesulfonyl group or toluenesulfonyl group, phosphono groups such as a diethylphosphono group, and heterocyclic groups such as a benzoxazole-2-yl group, benzothiazole-2-yl group, 3,4-dihydroquinazoline-4-one-2-yl group, 3,4-dihydroquinazoline-4-sulfone-2-yl group, as well as nitro group, imino group, or cyano group.

The above $E^1$ and $E^2$ groups may be bound to each other to form a ring. The ring formed by $E^1$ and $E^2$ is preferably a 5- or 6-membered carbon ring or heterocyclic group.

Examples of couplers include resorcin, phloroglucide, 2,3-dihydroxynaphthalene, sodium 2,3-dihydroxynaphthalene-6-sulfonate, 1-hydroxy-2-naphthoic acid morpholinopropylamide, sodium 2-hydroxy-3-naphthalene sulfonate, 2-hydroxy-3-naphthalene sulfonic acid anilide, 2-hydroxy-3-naphthalene sulfonic acid morpholinopropylamide, 2-hydroxy-3-naphthalene sulfonic acid-2-ethylhexyloxy propylamide, 2-hydroxy-3-naphthalene sulfonic acid-2-ethylhexylamide, 5-acetamide-1-naphthol, sodium 1-hydroxy-8-acetamide naphthalene 3,6-disulfonate, 1-hydroxy-8-acetamide naphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexane dione, 1,3-cyclopentane dione, 5-(2-n-tetradecyloxyphenyl)-1,3-cyclohexane dione, 5-phenyl-4-methoxycarbonyl-1,3-cyclohexane dione, 5-(2,5-di-n-octyloxyphenyl)-1,3-cyclohexane dione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis-(benzoylacetamide)toluene, 1,3-bis-(pivaloylacetamidemethyl) benzene, benzoyl acetonitrile, thenoyl acetonitrile, acetacetanilide, benzoylacetanilide, pivaloyl acetanilide, 2-chloro-5-(N-n-butylsulfamoyl)-1-pivaloyl acetamide benzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, 1-(4-n-octyloxyphenyl)-3-tert-butyl-5-aminopyrazol, etc.

These couplers are described in detail in JP-A No.4-201483, JP-A No.7-223367, JP-A No.7-223368, JP-A No.7-323660, and JP Patent Application Nos. 5-278608, 5-297024, 6-18669, 6-18670, 7-316280, 8-027095,8-027096, 8-030799,8-12610, 8-132394, 8-358755,8-358756, and 9-069990.

Examples of the couplers represented by formula (3) above are shown below, but suitable example are not limited thereto.

B-1

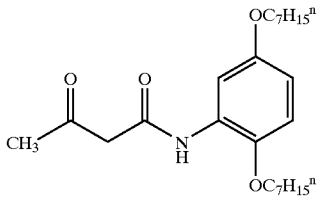

B-2

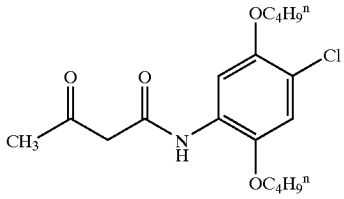

B-3

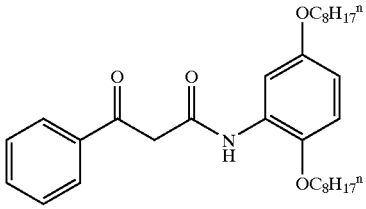

B-4

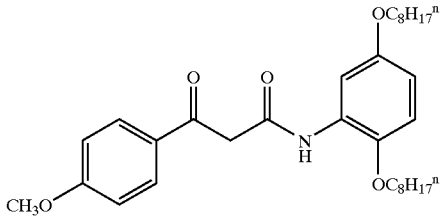

-continued

B-5

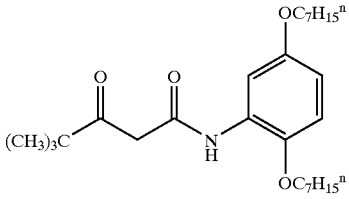

B-6

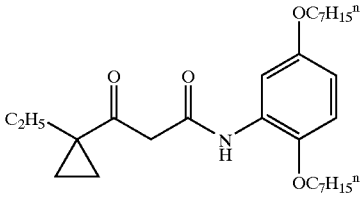

B-7

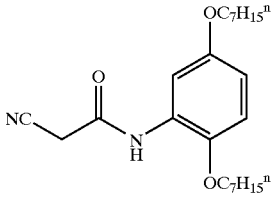

B-8

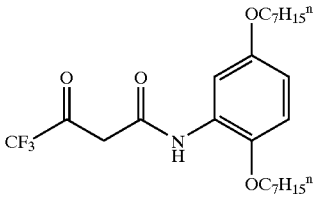

B-9

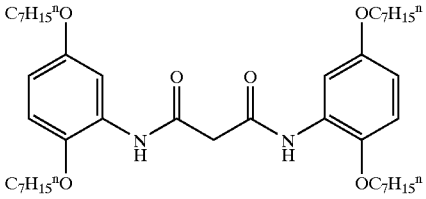

B-10

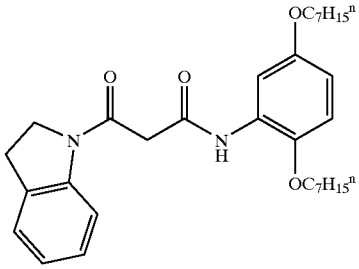

B-11

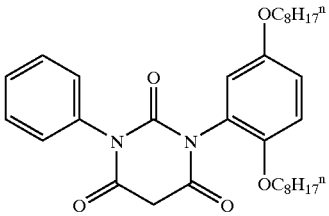

-continued
B-12
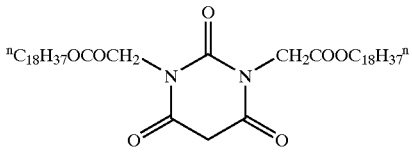
B-13
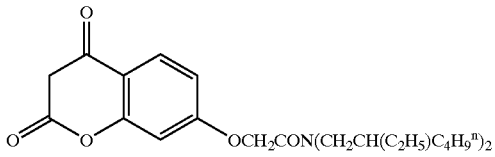
B-14
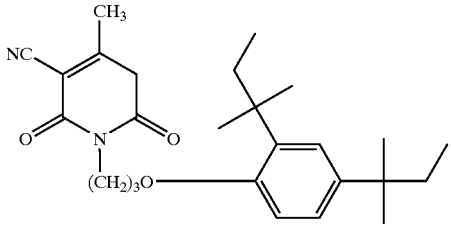
B-15
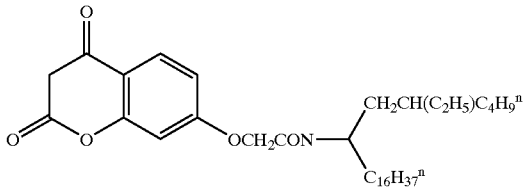
B-16
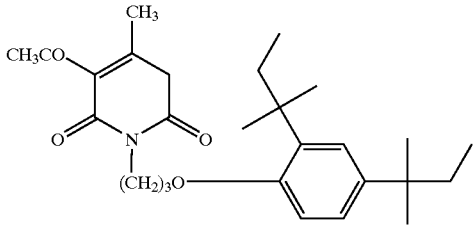
B-17
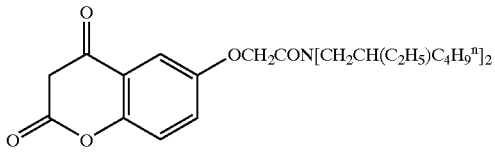
B-18
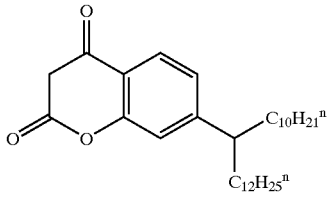
B-19
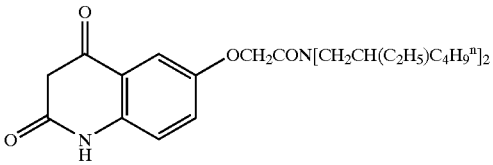
-continued
B-20
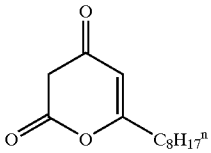
B-21
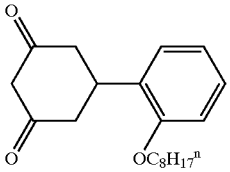
B-22
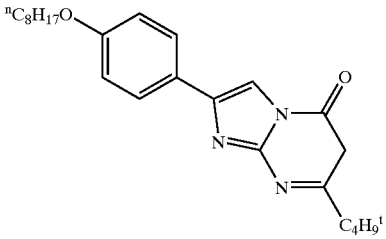
B-23
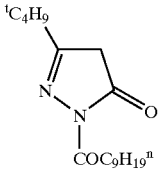
B-24
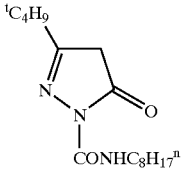
B-25
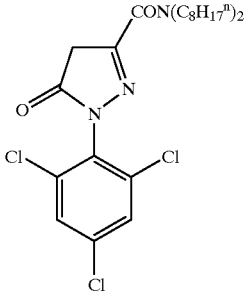
B-26
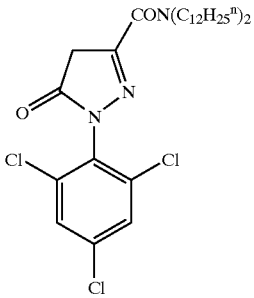

-continued

B-27

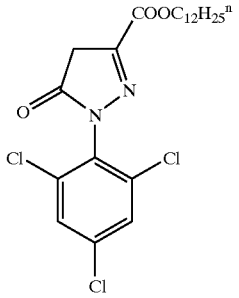

B-28

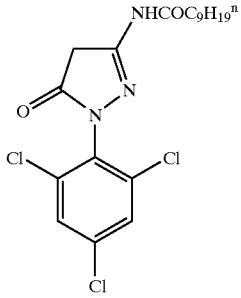

B-29

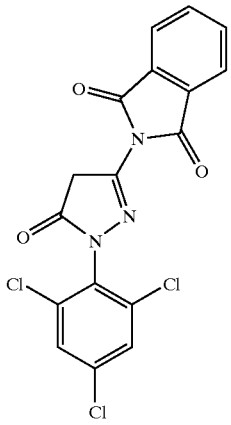

B-30

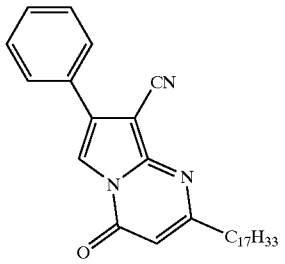

The content of the coupler in the heat-sensitive recording layer is preferably 0.1 to 30 parts by mass relative to 1 part by mass of the diazonium salt compound.

In the heat-sensitive recording material of the present invention, it is possible to use not only the diazonium salt compound and the coupler (diazo-type color producing agent) but also a combination of an electron-donating dye precursor and an electron-accepting compound (leuco-type color producing agent). For example, in the heat-sensitive recording material having a plurality of heat-sensitive recording layers on the support, at least one layer may be a layer containing a leuco-type color producing agent.

[Electron-Donating Dye Precursor]

Examples of electron-donating dye precursors include, e.g., triaryl methane type compounds, diphenyl methane type compounds, thiazine type compounds, xanthene type compounds, spiropyran type compounds, etc. In particular, triaryl methane type compounds and xanthene type compounds are preferable in respect of high color density.

Specifically, there can be mentioned the following compounds, such as 3,3-bis(p-dimethylaminophenyl)-6-dimethylaminophthalide (i.e., crystal violet lactone), 3,3-bis(p-dimethylamino)phthalide, 3-(p-dimethylaminophenyl)-3-(1,3-dimethylindole-3-yl)phthalide, 3-(p-dimethylaminophenyl)-3-(2-methylindole-3-yl)phthalide, 3-(o-methyl-p-dimethylaminophenyl)-3-(2-methylindole-3-yl)phthalide, 4,4'-bis(dimethylamino)benzhydrin benzyl ether, N-halophenyl leuco-auramine, N-2,4,5-trichlorophenyl leuco-auramine, rhodamine-B-anilinolactam, rhodamine(p-nitroanilino)lactam, rhodamine-B-(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexyl methylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoyl leucomethylene blue, p-nitrobenzyl leucomethylene blue, 3-methyl-spiro-dinaphthopyran, 3-ethyl-spiro-dinaphthopyran, 3,3'-dichloro-spiro-dinaphthopyran, 3-benzylspironaphthopyran, 3-propyl-spiro-dibenzopyran, etc.

The amount of the electron-donating dye precursor applied for coating is preferably 0.1 to 1 g/m$^2$ in the heat-sensitive recording layer for the same reason for the above-described diazonium salt compound.

[Electron-Accepting Compounds]

Examples of electron-accepting compounds include, e.g., phenol derivatives, salicylic acid derivatives, hydroxybenzoic acid esters, etc. In particular, bisphenols and hydroxybenzoic acid esters are preferable. Specifically, there can be mentioned the following compounds, such as 2,2-bis(p-hydroxyphenyl)propane (i.e., bisphenol A), 4,4'-(p-phenylenediisopropylidene)diphenol (i.e., bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl)propane, 1,1-(p-hydroxyphenyl)pentane, 1,1-(p-hydroxyphenyl)-2-ethylhexane, 3,5-di(α-methylbenzyl) salicylic acid and multivalent metal salts thereof, 3,5-di(tert-butyl)salicylic acid and multivalent metal salts thereof, 3-α,α-dimethyl benzyl salicylic acid and multivalent metal salts thereof, butyl p-hydroxybenzoate, benzyl p-hydroxybenzoate, 2-ethylhexyl p-hydroxybenzoate, p-phenyl phenol, p-cumyl phenol, etc.

The amount of the electron-accepting compound to be contained in the heat-sensitive recording layer is preferably 0.1 to 30 parts by mass relative to 1 part by mass of the electron-donating dye precursor.

(Other Components)

[Organic Base]

In the present invention, an organic base is preferably added for the purpose of accelerating the coupling reaction of the diazonium salt with the coupler. It is preferable that the organic base is contained in the photosensitive heat-sensitive recording layer together with the diazonium salt compound and the coupler, and organic bases may be used alone or in combination.

Examples of organic bases include nitrogenous compounds such as tertiary amines, piperidines, piperazines, amidines, formamidines, pyridines, guanidines, morpholines, etc. Further, such organic bases may be used as described in JP-B No.52-46806, JP-A No.62-70082, JP-A No.57-169745, JP-A No.60-94381, JP-A No.57-123086, JP-A No.58-1347901, JP-ANo.60-49991, JP-B No.2-24916, JP-B No.2-28479, JP-A No.60-165288 and JP-A No.57-185430.

Particularly preferable examples include piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl] piperazine, N,N'-bis(3-phenylthio-2-hydroxypropyl) piperazine, N,N'-bis[3-(β-naphthoxy)-2-hydroxypropyl] piperazine, N-3-(β-naphthoxy)-2-hydroxypropyl-N'-methyl piperazine and 1,4-bis{[3-(N-methylpiperazino)-2-hydroxy] propyloxy}benzene, morpholines such as N-[3-(β-naphthoxy)-2-hydroxy]propylmorpholine, 1,4-bis(3-morpholino-2-hydroxy-propyloxy) benzene and 1,3-bis(3-morpholino-2-hydroxy-propyloxy) benzene, piperidines such as N-(3-phenoxy-2-hydroxypropyl)piperidine and N-dodecyl piperidine, and guanidines such as triphenyl guanidine, tricyclohexyl guanidine and dicyclohexyl phenyl guanidine.

When the organic base is contained as necessary, the amount of the organic base to be contained in the heat-sensitive recording layer is preferably 0.1 to 30 parts by mass relative to 1 part by mass of the diazonium salt compound. PS [Sensitizer]

In addition to the organic base, a sensitizer can also be added to the heat-sensitive recording layer for the purpose of facilitating a color reaction.

The sensitizer is a material which serves to increase color density during thermal recording or to decrease the minimum coloring temperature, and also allows lowering of the melting point of the coupler, the organic base or the diazonium salt compound or lowering of the softening point of the capsule wall in order to facilitate the reaction among the diazonium salt compound, the organic base, the coupler and the like.

Preferable examples are low-boiling organic compounds suitably having an aromatic group and a polar group in the molecule, and include benzyl p-benzyloxybenzoate, α-naphthyl benzyl ether, β-naphthyl benzyl ether, phenyl β-naphthoate, phenyl α-hydroxy-β-naphthoate, β-naphthol-(p-chlorobenzyl) ether, 1,4-butanediol phenyl ether, 1,4-butanediol-p-methyl phenyl ether, 1,4-butanediol-p-ethyl phenyl ether, 1,4-butanediol-m-methyl phenyl ether, 1-phenoxy-2-(p-tolyloxy)ethane, 1-phenoxy-2-(p-ethylphenoxy)ethane, 1-phenoxy-2-(p-chlorophenoxy) ethane and p-benzyl biphenyl.

[Binder]

The binders used in the heat-sensitive recording layer include known water-soluble polymer compounds, latexes, etc.

Examples of water-soluble polymer compounds include methyl cellulose, carboxymethyl cellulose, hydroxyethyl cellulose, hydroxypropyl cellulose, starch derivatives, casein, gum arabic, gelatin, ethylene/maleic anhydride copolymers, styrene/maleic anhydride copolymers, polyvinyl alcohol, epichlorohydrin-modified polyamide, isobutylene/maleic anhydride salicylic acid copolymers, polyacrylic acid and polyacrylic acid amide, as well as modified products thereof. The latexes include styrene-butadiene rubber latex, methyl acrylate-butadiene rubber latex, vinyl acetate emulsion, etc.

[Pigments]

For the purpose of controlling hues, a pigment may also be contained in the heat-sensitive recording layer.

Known pigments, which may be organic or inorganic, can be used, and examples thereof include kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microbaloon, urea-formalin fillers, polyester particles, cellulose fillers, etc.

[Antioxidants]

In order to improve the fastness of a color developed images to light and heat or to reduce yellowing of an unprinted part (an unimaged portion) after fixation, the following known antioxidants are also preferably used.

The antioxidants include those described in European Patent Publication Nos. 223739, 309401, 309402, 310551, 310552 and 459416, German Patent Publication No. 3435443, JP-A No.54-48535, JP-A No.62-262047, JP-A No.63-113536, JP-A No.63-163351, JP-A No.2-262654, JP-A No.2-71262, JP-A No.3-121449, JP-A No.5-61166, JP-A No.5-119449, and U.S. Pat. Nos. 4,814,262 and 4,980,275.

In the present invention, there is no particular limitation to the mode of use of using diazonium salt compounds, couplers for color development by causing a thermal reaction with the diazonium salt compound, additional components such as organic base and sensitizer, the electron-donating dye precursor, and the electron-accepting compound. Preferable modes include (1) a method using the above compounds in the form of a solid dispersion, (2) a method using the above compounds in the form of an emulsified dispersion, (3) a method using the above compounds in the form of a polymer dispersion, (4) a method using the above compounds in the form of a latex dispersion, and (5) a method utilizing the above compounds in the form of microcapsules. In particular, (5) a method utilizing the above compounds in the form of microcapsules is preferable from the viewpoint of shelf storage. Particularly in (i) a color development system where the diazonium salt compound is allowed to react with the coupler, the mode of microencapsulating the diazonium salt compound is preferable, and in (ii) a color development system where the electron-donating dye precursor is allowed to react with the electron-accepting compound, the mode of microencapsulating the electron-donating dye precursor is preferable.

(Method of Producing the Microcapsules)

In order to improve the shelf stability of the heat-sensitive recording material of the present invention, it is preferred to encapsulate the diazonium salt compound and/or the electron-donating dye precursor in microcapsules.

As the method of microencapsulating the color developing components, known conventional methods can be used. A preferable method is an interfacial polymerization method wherein the diazonium salt compound (and the electron-donating dye precursor) as one color developing component is dissolved or dispersed in an organic solvent which is low in solubility or insoluble in water, and the resulting oil phase is mixed with an aqueous phase containing the water-soluble polymer dissolved therein, then emulsified and dispersed by means of, e.g., a homogenizer followed by heating, whereby polymerization reaction occurs at the interface of the oil droplets to form a microcapsule wall encapsulating the polymer. The interfacial polymerization method allows formation of capsules having uniform particle diameter in a short time and production of the recording material excellent in shelf stability.

Examples of organic solvents include, e.g., low-boiling co-solvents such as acetic acid ester, methylene chloride and cyclohexanone, and/or phosphoric acid ester, carboxylic acid esters such as phthalic acid ester, acrylic acid ester, methacrylic acid ester, etc., fatty acid amides, alkylated biphenyl, alkylated terphenyl, alkylated naphthalene, diaryl ethane, chlorinated paraffin, alcohol type solvent, phenol type solvent, ether type solvent, monoolefin type solvent, epoxy type solvent, etc.

Specific examples thereof include high-boiling solvents such as tricresyl phosphate, trioctyl phosphate, octyldiphenyl phosphate, tricyclohexyl phosphate, dibutyl phthalate, dioctyl phthalate, dilaurate phthalate, dicyclohexyl phthalate, butyl olefinate, diethylene glycol benzoate, dioctyl sebacate, dibutyl sebacate, dioctyl adipate, trioctyl trimellitate, acetyl triethyl citrate, octyl maleate, dibutyl maleate, isoamyl biphenyl, chlorinated paraffin, diisopropyl naphthalene, 1,1'-ditolyl ethane, 2,4-di-tert-amyl phenol, N,N-dibutyl-2-butoxy-5-tert-octyl aniline, 2-ethylhexyl hydroxybenzoate, and polyethylene glycol.

Among these, the alcohol type solvent, phosphate type solvent, carboxylate type solvent, alkylated biphenyl, alkylated terphenyl, alkylated naphthalene, and diaryl ethane are particularly preferable.

Further, oxidation inhibitors such as hindered phenol and hindered amine may be added to the high-boiling solvent. The high-boiling solvent is preferably a solvent particularly having unsaturated fatty acid, and examples include α-methyl styrene dimers. The α-methyl styrene dimers include, e.g., "MSD100" produced by Mitsui Toatsu Chemicals, Inc.

Examples of water-soluble polymers include water-soluble polymers such as polyvinyl alcohol. Preferable examples include polyvinyl alcohol, silanol-modified polyvinyl alcohol, carboxy-modified polyvinyl alcohol, amino-modified polyvinyl alcohol, itaconic acid-modified polyvinyl alcohol, styrene/maleic anhydride copolymers, butadiene/maleic anhydride copolymers, ethylene/maleic anhydride copolymers, isobutylene/maleic anhydride copolymers, polyacrylamide, polystyrenesulfonic acid, polyvinyl pyrrolidone, ethylene/acrylic acid copolymers, gelatin, etc. Among these, carboxy-modified polyvinyl alcohol is preferable.

The water-soluble polymer can be used in combination with a hydrophobic polymer emulsion or latex. The emulsion or latex includes styrene/butadiene copolymers, carboxy-modified styrene/butadiene copolymers and acrylonitrile/butadiene copolymers. If necessary, a known conventional surfactant or the like may be added.

The polymer materials constituting the microcapsule wall include, e.g., polyurethane resin, polyurea resin, polyamide resin, polyester resin, polycarbonate resin, aminoaldehyde resin, melamine resin, polystyrene resin, styrene/acrylate copolymer resin, styrene/methacrylate copolymer resin, gelatin, polyvinyl alcohol, etc. Among these, polyurethane polyurea resin is particularly preferable.

For example, when polyurethane polyurea resin is used as the capsule wall material, a microcapsule wall precursor such as polyvalent isocyanate is encapsulated and incorporated in an oily medium (oil phase) as a core material, while a second material (e.g., polyol, polyamine) which reacts with the microcapsule wall precursor to form a capsule wall is incorporated in the aqueous water-soluble polymer solution (aqueous phase), and after the oil phase is emulsified and dispersed in the aqueous phase, the resultant emulsified dispersion is heated whereby polymerization reaction occurs at the interface of oil droplets to finally form a microcapsule wall.

Examples of the polyvalent isocyanate compounds are shown below. However, these are not intended to limit the present invention. Examples thereof include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate, triisocyanates such as 4,4',4"-triphenylmethane triisocyanate and toluene-2,4,6-triisocyanate, tetraisocyanates such as 4,4'-dimethylphenylmethane-2,2',5,5'-tetraisocyanate, and isocyanate prepolymers such as an adduct of hexamethylene diisocyanate and trimethylol propane, an adduct of 2,4-tolylene diisocyanate and trimethylol propane, an adduct of xylylene diisocyanate and trimethylol propane, and an adduct of tolylene diisocyanate and hexane triol.

As necessary, these compounds may be used in combination thereof. Those compounds having 3 or more isocyanate groups in the molecule are particularly preferable.

In the method of forming microcapsules, the organic solvent for dissolving the coupler (and the electron-accepting compound), the organic base and other components such as sensitizer, and the microcapsule wall precursor and the second material reacting therewith is the same as the organic solvent described above.

The particle diameter of the microcapsules is preferably 0.1 to 1.0 μm, more preferably 0.2 to 0.7 μm.

Hereinafter, specific modes of the multicolor recording material are described.

The heat-sensitive recording material of the present invention may be a single-color heat-sensitive recording material having one heat-sensitive recording layer on a support, or a multicolor heat-sensitive recording material having a plurality of single-color heat-sensitive recording layers laminated on a support. The multicolor heat-sensitive recording material is preferably one wherein at least one of the heat-sensitive recording layers is a light-fixing type recording layer containing a diazonium salt compound and a coupler reacting with the diazonium salt compound to develop color.

Particularly, in the case of a heat-sensitive recording material comprising full-color heat-sensitive recording layers containing cyan, yellow and magenta, preferred is one wherein all the 3 layers on the support comprise a diazo type color developing agent, or the first heat-sensitive recording layer from the support comprises a leuco type color developing agent containing an electron-donating dye and an electron-accepting compound while the second and third heat-sensitive recording layers comprise a diazo type color developing agent.

For example, it may be constituted as shown in the modes (a) to (c): that is, the recording material (a) wherein a light-fixing type recording layer (first recording layer (layer A)) containing a diazonium salt compound having the maximum absorption wavelength of 360±20 nm and a coupler reacting with the diazonium salt compound to develop color, and another light-fixing type recording layer (second recording layer (layer B)) containing a diazonium salt compound having the maximum absorption wavelength of 400±20 nm and a coupler reacting with the diazonium salt compound to develop color, are laminated in this order on a support, and additionally a light transmittance-adjusting layer and a protective layer are arranged as necessary above the layers;

the recording material (b) wherein a recording layer (first recording layer (layer A)) containing an electron-donating dye and an electron-accepting compound, a light-fixing type recording layer (second recording layer (layer B)) containing a diazonium salt compound having the maximum absorption wavelength of 360±20 nm and a coupler reacting with the diazonium salt compound to develop color, and a light-fixing type recording layer (third recording layer (layer C)) containing a diazonium salt compound having the maximum absorption wavelength of 400±20 nm and a coupler reacting with the diazonium salt compound to develop color are laminated in this order on a support, and additionally a light transmittance-adjusting layer and a protective layer are arranged as necessary above the layers; and the recording material (c) wherein a light-fixing type recording layer (first recording layer (layer A)) containing a diazonium salt compound having the maximum absorption wavelength of 340±20 nm and a coupler reacting with the diazonium salt compound to develop color, a light-fixing type recording layer (second recording layer (layer B)) containing a diazonium salt compound having the maximum absorption wavelength of 360±20 nm and a coupler reacting with the diazonium salt compound to develop color, and a light-fixing type recording layer (third recording layer (layer C)) containing a diazonium salt compound having the maximum absorption wavelength of 400±20 nm and a coupler reacting with the diazonium salt compound to develop color are laminated in this order on a support, and further a light transmittance-adjusting layer and a protective layer are arranged as necessary above the layers.

The method of multicolor recording performed using the recording material (b) or (c) above is described below.

First, the third recording layer (layer C) is heated to cause color development between the diazonium salt and the coupler contained in the layer. Then, a light of wavelength of 400±20 nm is irradiated and after light fixation by decomposing the unreacted diazonium salt compound in layer C, sufficient heat is applied to the second recording layer (layer B) to cause color development between the diazonium salt compound and the coupler contained in said layer. The layer C is also simultaneously strongly heated, but the diazonium salt compound has previously been decomposed (light fixation) to lose its color developing ability, and thus layer C does not develop color. Further, a light of wavelength of 360±20 nm is applied and after light fixation by decomposing the diazonium salt compound in layer B, sufficient heat is finally applied to the first recording layer (layer A) to develop color. At this moment, strong heat is simultaneously applied to the recording layers of layers B and C, but the diazonium salt compound has already been decomposed to lose its color developing ability, and thus layers B and C do not develop color.

The respective layers are arranged preferably such that the yellow color forming layer which is low in visibility is provided as the lowermost layer in order to reduce the influence of the rough surface of the support on image qualities to thereby improve image qualities.

If all the recording layers (layers A, B and C) contain diazo type compounds, it is necessary to effect photo-fixation of layers A and B after color development, but it is not always necessary to effect photo-fixation of layer C in which image recording is conducted lastly. However, from the viewpoint of improving the stability of formed images, photo-fixation is preferably conducted.

The light source used for photo-fixation can be suitably selected from known light sources, and examples thereof include various fluorescent lamps, xenon lamps, mercury lamps, etc. In particular, a light source whose emission spectrum almost corresponds to the absorption spectrum of the diazonium salt compound used in the recording material is preferably used to achieve highly efficient photo-fixation.

—Other Layers—

In a preferable mode, the heat-sensitive recording material of the present invention preferably has a light transmittance-adjusting layer and a protective layer, in addition to the one or more heat-sensitive recording layers on the support.

(Light Transmittance-Adjusting Layer)

The light transmittance-adjusting layer contains a UV absorber precursor, and before irradiation with a light of wavelength in the range necessary for fixation, said precursor does not function as UV absorber and thus the light transmittance of said layer is high. When fixing the light-fixing type heat-sensitive recording layer, the light transmittance-adjusting layer permits not only visible lights but also a light of wavelength in the range necessary for fixation to sufficiently pass therethrough, and thus the fixation of the heat-sensitive recording layer is not adversely affected. This UV absorber precursor is preferably contained in the microcapsules.

The compounds contained in this light transmittance-adjusting layer include those described in JP-A 9-1928.

After irradiation of the heat-sensitive recording layer with a light of wavelength in the range necessary for fixation, the UV absorber precursor, upon undergoing optical or thermal reaction, comes to function as a UV absorber, which absorbs a majority of UV light of wavelengths in the range necessary for fixation, thus lowering the transmittance and improving the light resistance of the heat-sensitive recording material, while the transmittance of visible light is substantially unchanged because it has no effect of absorbing visible light.

At least one light transmittance-adjusting layer can be arranged in the heat-sensitive recording material, most preferably between the heat-sensitive recording layer and the outermost protective layer. Alternatively, the light transmittance-adjusting layer may be provided to also serve as the protective layer. The characteristics of the light transmittance-adjusting layer can be arbitrarily selected depending on the characteristics of the heat-sensitive recording layers.

A coating solution for forming the light transmittance-adjusting layer (a coating solution for the light transmittance-adjusting layer) is prepared by mixing the respective components described above. The light transmittance-adjusting layer can be formed by applying the coating solution by known coating techniques using, e.g., a bar coater, an air knife coater, a blade coater, a curtain coater, etc. The light transmittance-adjusting layer can be formed simultaneously with formation of the heat-sensitive recording layer, etc. Alternatively, the coating solution for the heat-sensitive recording layer is first coated, and after the resultant heat-sensitive layer is dried, the light transmittance-adjusting layer may be formed above said layer.

(Protective Layer)

The protective layer comprises, in addition to a binder, a pigment, a lubricant, a surfactant, a dispersant, a fluorescent brightener, a metal soap, a hardener, a UV absorber, a crosslinking agent, etc.

The binder and pigment can be selected suitably from water-soluble binders and pigments usable in the back coat layer described above. Other binders include synthetic rubber latex, synthetic resin emulsion, etc. Examples thereof include styrene-butadiene rubber latex, acrylonitrile-butadiene rubber latex, methyl acrylate-butadiene rubber latex and vinyl acetate emulsion, etc.

The amount of the binder to be contained is preferably 10 to 500% by mass, more preferably 50 to 400% by mass, relative to the pigment in the protective layer.

For the purpose of further improving water resistance, it is effective to use a crosslinking agent in combination with a catalyst for promoting its reaction. Examples of crosslinking agents include, e.g., epoxy compounds, blocked isocyanates, vinyl sulfone compounds, aldehyde compounds, methylol compounds, boric acid, carboxylic anhydrides, silane compounds, chelating compounds, halides, etc. The crosslinking agent is preferably one capable of adjusting the pH of the coating solution to 6.0–7.5. The catalysts include known acids, metal salts, etc., preferably those capable of adjusting the pH of the coating solution to 6.0–7.5.

Preferable examples of the lubricants include zinc stearate, calcium stearate, paraffin wax, polyethylene wax, etc.

For formation of a uniform protective layer on the heat-sensitive recording layer, the surfactant is preferably an alkali metal salt based on sulfosuccinic acid, a fluorine-containing surfactant, etc., and specifically sodium salts, ammonium salts and like salts of di-(2-ethylhexyl) sulfosuccinic acid, di-(n-hexyl)sulfosuccinic acid, etc. are used.

A coating solution for forming the protective layer (a coating solution for the protective layer) is prepared by mixing the components described above. If necessary, a releasing agent, a wax, a water repellant, etc. may be added.

The heat-sensitive recording material of the present invention can be formed by applying the solution for the protective layer by known coating techniques onto the heat-sensitive recording layer formed on the support. The known coating techniques include those using, e.g., a bar coater, an air knife coater, a blade coater, a curtain coater, etc.

The amount of the coated protective layer after drying is preferably 0.2 to 7 g/m$^2$, more preferably 1 to 4 g/m$^2$. If the amount of the dried layer is less than 0.2 g/m$^2$, water resistance cannot be maintained in some cases, while if it exceeds 7 g/m$^2$, heat sensitivity may be significantly lowered. After the protective layer is formed by coating, calendering may be conducted if necessary.

(Intermediate Layer)

When plural heat-sensitive recording layers are laminated, it is preferred to provide an intermediate layer among the respective heat-sensitive recording layers. Similarly to the protective layer, the intermediate layer may contain, in addition to various binders, a pigment, a lubricant, a surfactant, a dispersant, a fluorescent brightener, a metal soap, a UV absorber, etc. As the binder, the same binders as used in the protective layer can be employed.

(Support)

Examples of supports include, e.g., polyester films such as polyethylene terephthalate and polybutylene terephthalate, cellulose derivative films such as cellulose triacetate film, polyolefin films such as polystyrene film, polypropylene film and polyethylene film, and synthetic polymer films such as polyimide film, polyvinyl chloride film, polyvinylidene chloride film, polyacrylic acid copolymer film and polycarbonate film, as well as paper, synthetic paper, plastic resin-containing paper, etc.

The support may be used alone or plural supports may be attached to one another.

The plastic resin-containing paper preferably comprises a base paper and a thermoplastic resin-containing layer formed on both sides of the paper or on the side on which at least the heat-sensitive recording layer is to be formed. The support includes (i) a base paper having thermoplastic resin melt-extruded and deposited thereon, (ii) a base paper having a gas barrier layer applied above the layer of thermoplastic resin melt-extruded and deposited on the paper, (iii) a base paper having a plastic film of low oxygen permeability adhered thereon, (iv) a base paper having the layer of thermoplastic resin melt-extruded and deposited on the plastic film adhered on the paper, or (v) a base paper having the layer of thermoplastic resin melt-extruded and deposited thereon and further having a plastic film adhered on the layer.

Examples of thermoplastic resins to be melt-extruded and applied on a base paper include olefin resins, for example, $\alpha$-olefin homopolymers such as polyethylene, polypropylene, etc., mixtures thereof, or random copolymers of ethylene and vinyl alcohol. As a preferable polyethylene, LDPE (low-density polyethylene), HDPE (high-density polyethylene), L-LDPE (linear low-density polyethylene) or the like is mentioned.

The method of laminating a plastic film on a base paper can be selected suitably from known laminating techniques described in "Shin Laminate Kako Binran" (New Handbook of Laminating Technology) (edited by Kako Gijyutsu Kenkyukai), but it is preferable to employ so-called dry lamination, solvent-free dry lamination, dry lamination using an electron beam curing resin or ultraviolet curing resin, or hot dry lamination.

Among the various supports described above, a paper support comprising a base paper laminated with polyethylene on at least one side thereof is preferable, and generally polyethylene is laminated on the surface of the side on which the heat-sensitive recording layer is formed. A paper support comprising a base paper laminated with polyethylene on both sides thereof is more preferable, and lamination is provided on the surface of the side on which the heat-sensitive recording layer is to be formed for the purpose of improving flatness, and on the surface of the other side for the purpose of adjusting curling balance.

The synthetic polymer film described above may have color exhibiting an arbitrary hue, and the methods of coloring the polymer film include (i) a method in which a dye is kneaded with a resin and then formed into a film, and (ii) a method in which a dye is dissolved in a suitable solvent and then the resultant coating solution is coated and dried on a transparent colorless resin film by known coating techniques such as gravure coating, roller coating, wire coating or the like. Particularly, it is preferable to make a film using a method in which a blue dye is kneaded with a polyester resin such as polyethylene terephthalate or polyethylene naphthalene, formed into a film, which is subjected to heat resistance treatment, elongation, and antistatic treatment.

The thickness of the support is preferably 25 to 300 $\mu$m, more preferably 50 to 250 $\mu$m.

The heat-sensitive recording layer, the protective layer, the light transmittance-adjusting layer and the intermediate layer can be formed on the support by application of coating by known coating techniques such as blade coating, air knife coating, gravure coating, roll coating, spray coating, dip coating, bar coating, etc., followed by drying.

EXAMPLES

Hereinafter, the present invention is described by reference to the Examples, which however are not intended to limit the present invention. Hereinafter, "parts" and "%" in the Examples refer to "parts by mass" and "% by mass", respectively. In the following description, the diazonium salt compound may occasionally be referred to simply as the diazo compound.

Example 1

(1) Preparation of a Support

Wood pulp consisting of 100 parts of LBKP was beaten by a double disk refiner to 300 ml Canadian freeness, and to the resultant pulp were addded 0.5 parts of epoxylated behenic acid amide, 1.0 parts of anion polyacrylamide, 0.1 parts of polyamide polyamine epichlorohydrin, and 0.5 parts of cation polyacrylamide, based on the ratio of the absolute dry weight thereof to that of the pulp, and weighed by a wire paper machine to produce a 100 g/m$^2$ base paper, and the surface of the paper was sized with polyvinyl alcohol in an absolute dry weight of 1.0 g/m$^2$ and then calendered to give a base paper with a regulated density of 1.0.

The wire surface (back) of the resulting base paper was subjected to corona discharge treatment and coated with high-density polyethylene to a thickness of 30 $\mu$m thereon using a melt-extrusion machine to form a resin layer having a mat surface thereon (hereinafter, the surface of the resin layer is referred to as "back"). The back, i.e., the surface of the resin layer was further subjected to corona discharge treatment, and then a dispersion of aluminum oxide (ALUMINA SOL 100, Nissan Chemical Industries, Ltd.) and silicon dioxide (SNOWTEX O, Nissan Chemical Industries, Ltd.) in a ratio of 1:2 (by mass) dispersed in water was applied thereon to achieve a dry weight of 0.2 g/m$^2$.

The felt surface (front) of the base paper on which the resin layer had not been provided was subjected to corona discharge treatment, and low-density polyethylene containing 10% titanium oxide and a very small amount of ultramarine was melt-extruded to a thickness of 40 $\mu$m on that surface, to form a highly glossy thermoplastic resin layer on the front of the base paper as the support (hereinafter, this highly glossy surface is referred to as "front") to thus produce a support. The polyethylene face on the front was subjected to corona discharge treatment.

(2) Formation of a Back Coat Layer

—Preparation of a Coating Solution for the Outermost Back Layer—

8 parts of water-swelling synthetic mica (SOMASHIF ME100, Corp Chemical Co., Ltd.) were mixed with 92 parts of water and then wet-dispersed using a visco mill to give a mica dispersion having an average particle diameter of 2.0 $\mu$m. To 100 parts of this dispersion was added 150 parts of water and mixed thoroughly to form a uniform solution. While the temperature was kept at 40° C., 400 parts of 15% aqueous alkali-treated gelatin solution was added to the resultant solution with stirring, followed by further addition of 20 parts of 2% sodium (4-nonylphenoxytrioxyethylene) butyl sulfonate, to give a mica-containing coating solution for the outermost back layer.

—Preparation of a Coating Solution for the Intermediate Back Layer—

300 parts of 15% aqueous alkali-treated gelatin solution, 100 parts of 2% di-2-ethylhexyl sulfosuccinate solution and 1800 parts of water were admixed to give a coating solution for the intermediate back layer.

—Formation of the Back Coat Layer—

The coating solution for the intermediate back layer and the coating solution for the outermost back layer were applied in this order onto the surface (back) of the support in amounts to give 8 g/m$^2$ and 2 g/m$^2$ in dry weights, respectively, followed by drying to form a back coat layer consisting of two layers, i.e., the intermediate back layer and the outermost back layer on the support.

(3) Preparation of a Coating Solution for a Subbing Layer 97.5 parts of water were added to 2.5 parts of oil-swelling synthetic mica "ME100" (Corp Chemical Co., Ltd.) so as to make a dispersion using a Dyna mill. The resultant dispersion was added to 200 parts of 5% aqueous gelatin solution having a temperature of 40° C. and stirred for 30 minutes, and 20 ml of 5% aqueous solution of surfactant-1 shown below was added thereto to prepare a coating solution for a subbing layer.

Surfactant-1

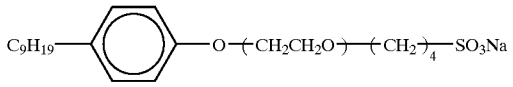

(4) Preparation of a Coating Solution for the Cyan Color Forming Heat-Sensitive Recording Layer —Preparation of a Microcapsule Solution A Containing the Electron-Donating Dye Precursor—

(i) Solution a 5 parts of 3-(o-methyl-p-dimethyl aminophenyl)-3-(1'-ethyl-2'-methylindole-3-yl)phthalide (electron-donating dye precursor) were dissolved in 20 parts of ethyl acetate, and 20 parts of 1-phenyl-1-xylyl ethane (high-boiling solvent) were added thereto and thoroughly mixed with heating. To the resultant uniform solution were added 20 parts of an adduct of xylylene diisocyanate/trimethylol propane in a ratio of 1/3 as a material to form capsule walls and then stirred, to give a uniform Solution a.

(ii) Solution b 2 parts of 2% aqueous sodium dodecylsulfonate solution were added to 54 parts of 6% aqueous phthalated gelatin solution to give Solution b.

Solution a was added to Solution b obtained above, and then dispersed and emulsified using a homogenizer to give an emulsified dispersion. 68 parts of water was added to the resulting emulsified dispersion and mixed thoroughly, and the resulting uniform mixture was heated to 50° C. with stirring. This encapsulating reaction was continued for 3 hours until the average diameter of the microcapsules produced was reduced to 1.2 $\mu$m, to give a microcapsule solution A which included microcapsules containing the electron-donating dye precursor.

—Preparation of a Developer-Emulsified Dispersion B—

2.5 parts of 1,1-(p-hydroxyphenyl)-2-ethyl hexane (developer), 0.3 parts of tricresyl phosphate and 0.1 parts of diethyl maleate were dissolved in 10 parts of ethyl acetate. The resulting solution was introduced into a solution prepared by mixing 20 parts of 6% aqueous gelatin solution with 2 parts of 2% aqueous sodium dodecylsulfonate solution, and subjected to emulsification for 10 minutes using a homogenizer to prepare a dispersion B in which the developer had been emulsified and dispersed.

—Preparation of a Coating Solution for the Cyan Color Forming Heat-Sensitive Recording Layer—

SBR latex (SN-307, Sumitomo Naugatack Co., Ltd.) was added, in an amount of 40% relative to the solid content of the microcapsules, to the microcapsule solution C which comprises microcapsules containing the electron-donating dye precursor, and then the developer-emulsified and dispersed solution D was added thereto in a ratio of 1/4 relative to the microcapsule solution C containing the electron-donating dye precursor, to give a coating solution for the cyan color forming heat-sensitive recording layer.

(5) Preparation of a Coating Solution for the Magenta Color Forming Heat-Sensitive Recording Layer —Preparation of a Microcapsule Solution C Containing a Diazo Compound 2.8 parts of the diazo compound (1) shown below (decomposed by irradiating with a light at a wavelength of 365 nm) were dissolved in 20 parts of ethyl acetate, and to the resultant mixture were added 12 parts of diisopropyl naphthalene and mixed thoroughly with heating. 15 parts of an adduct of xylylene diisocyanate/trimethylol propane in a ratio of 1/3 were added, to serve as a capsule wall material, to the resulting solution and thoroughly mixed to give a uniform solution I containing the diazo compound.

The resulting solution I was added to a solution prepared by mixing 54 parts of 6% aqueous phthalated gelatin solution with 2 parts of 2% aqueous sodium dodecylsulfonate solution, and then emulsified and dispersed using a homogenizer. 68 parts of water was added to the resulting emulsified dispersion and thoroughly mixed, and heated to 40° C. with stirring, to cause an encapsulating reaction. The reaction was continued for 3 hours until the average diameter of the capsules was reduced to 1.2 μm, to thus give a microcapsule solution C containing the diazo compound.

Diazo compound (1)

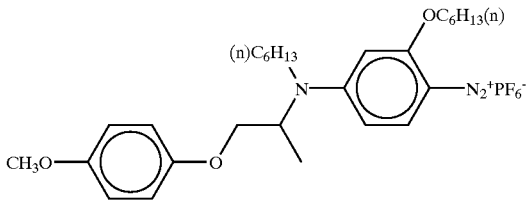

—Preparation of a Coupler-Emulsified Dispersion D—

2 parts of the coupler (1) shown below, 2 parts of 1,2,3-triphenyl guanidine, 0.3 parts of tricresyl phosphate and 0.1 parts of diethyl maleate were dissolved in 10 parts of ethyl acetate. The resulting solution was introduced into an aqueous solution prepared by mixing 20 parts of 6% aqueous gelatin solution with 2 parts of 2% aqueous sodium dodecylsulfonate solution, and then emulsified for 10 minutes using a homogenizer to give a coupler-emulsified dispersion D.

Coupler (1)

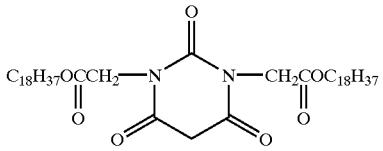

—Preparation of a Coating Solution for the Magenta Color Forming Heat-Sensitive Recording Layer—

SBR latex (SN-307, Sumitomo Norgatack Co., Ltd.) was added, in an amount of 40% relative to the solid content of the microcapsules, to the microcapsule solution C containing the diazo compound, and then the coupler-emulsified dispersion D was added thereto in a mass ratio of 3/2 relative to the microcapsule solution C containing the diazo compound, to give a coating solution for the magenta color forming heat-sensitive recording layer.

(6) Preparation of a Coating Solution for the Yellow Color Forming Heat-Sensitive Recording Layer —Preparation of a Microcapsule Solution E Containing a Diazo Compound—

3.0 parts of 2,5-dibutoxy-4-tolylthiobenzene diazonium hexafluorophosphate (diazo compound decomposed by irradiating with a light at a wavelength of 420 nm) were dissolved in 20 parts of ethyl acetate, and to the resultant mixture were added 7 parts of tricresyl phosphate and 4 parts of monoisopropyl biphenyl as the high-boiling solvent, and mixed thoroughly with heating. To the obtained uniform solution were added 15 parts of an adduct of xylylene diisocyanate/trimethylol propane in a ratio of 1/3, to serve as a capsule wall material, and thoroughly mixed to give a uniform solution II containing the diazo compound.

The resulting solution II was added to a solution prepared by mixing 54 parts of 6% aqueous phthalated gelatin solution with 2 parts of aqueous sodium dodecylsulfonate solution, and emulsified and dispersed using a homogenizer. 68 parts of water were added to the resulting emulsified dispersion and thoroughly mixed, and heated to 40° C. with stirring, and to cause an encapsulating reaction. The reaction was continued for 3 hours until the average diameter of the capsules was reduced to 1.3 μm, to thereby give a microcapsule solution E containing the diazo compound.

—Preparation of a Coupler-emulsified Dispersion F—

2 parts of 2-chloro-5-(3-(2,4-di-tert-pentyl) phenoxypropylamino)acetacetanilide, 1 part of 1,2,3-triphenyl guanidine, 0.3 parts of tricresyl phosphate and 0.1 parts of diethyl maleate were dissolved in 10 parts of ethyl acetate. The resulting solution was introduced into an aqueous solution prepared by mixing 20 parts of 6% aqueous gelatin solution with 2 parts of 2% aqueous sodium dodecylsulfonate solution, and emulsified for 10 minutes using a homogenizer to give a coupler-emulsified dispersion F.

—Preparation of a coating solution for the yellow color forming heat-sensitive recording layer—

The coupler-emulsified dispersion F was mixed in a mass ratio of 3/2 with the microcapsule solution E containing the diazo compound, to give a coating solution for the yellow color forming heat-sensitive recording layer.

(7) Preparation of a Coating Solution for the Intermediate Layer 3 parts of 15% aqueous polyacrylic acid (JULIMER AC-10L, Nippon Jyunyaku Co., Ltd.) were thoroughly mixed with 10 parts of 15% aqueous gelatin solution (#750, Nitta Gelatin Co., Ltd.), to give a uniform coating solution for the intermediate layer.

(8) Preparation of a Coating Solution for the Light Transmittance-adjusting Layer 1.5 parts of the compound shown below, 0.5 parts of compound R-6 as a reducing agent, 6.0 parts of ethyl acetate and 0.8 parts of tricresyl phosphate were sufficiently mixed to give a solution. To this solution were further added 3.0 parts of xylylene diisocyanate/trimethylol propane (TAKENATE D110N, 75% ethyl acetate solution, Takeda Chemical Industries, Ltd.) and then stirred. 29.7 parts of 8% aqueous carboxy-modified polyvinyl alcohol (KL-318, Kuraray Co., Ltd.) were added thereto, and emulsified and dispersed using a homogenizer. The resulting emulsified dispersion was added to 40 parts of deionized water and stirred at 40° C. for 3 hours for effecting an encapsulating reaction. Thereafter, 7.0 parts of ion-exchange resin AMBERLITE MB-03 (Japan Organo Co., Ltd.) were added thereto, and stirred for an additional 1 hour, to prepare a coating solution for the light transmittance-adjusting layer. The average diameter of the microcapsules was 0.35 μm.

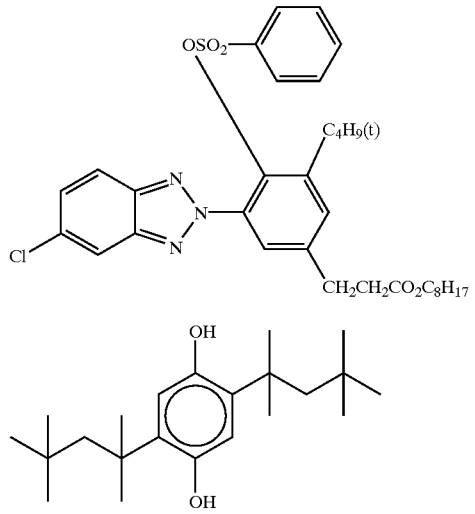

R-6

(9) Preparation of a Coating Solution for the Protective Layer

The following ingredients were mixed to prepare a coating solution for the protective layer

| | |
|---|---|
| EP130 (7%) | 100 g |

(dodecyl-modified polyvinyl alcohol produced by Denki Kagaku Kogyo K.K.)

| | |
|---|---|
| water | 50 g |
| BARIFINE BF21 dispersion (20%) | 10 g |

(barium sulfate ultrafine particles produced by Sakai Chemical Industry Co., Ltd.)

| | |
|---|---|
| the above surfactant-1 (2%) | 5 ml |
| the following surfactant-2 (5%) | 5 ml |

Surfactant-2

$C_8F_{17}SO_2N(CH_2CH_2CH_3)CH_2COOK$

(10) Preparation of the Heat-sensitive Recording Material

The coating solutions for the subbing layer, the cyan color forming heat-sensitive recording layer, the intermediate layer, the magenta color forming heat-sensitive recording layer, the intermediate layer, the yellow color forming heat-sensitive recording layer, the light transmittance-adjusting layer, and the protective layer were applied successively in this order onto the front (polyethylene surface) of the above support and subjected to corona discharge treatment, to form multiple layers thereon, followed by drying to give the multicolor heat-sensitive recording material (1) of the present invention.

The amounts of the respective coating solutions applied, in terms of solid content after drying, were 1.0 g/m$^2$ for the subbing layer, 7.2 g/m$^2$ for the cyan color forming heat-sensitive recording layer, 2.0 g/m$^2$ for the intermediate layer, 7.8 g/m$^2$ for the magenta color forming heat-sensitive recording layer, 2.0 g/m$^2$ for the intermediate layer, 5.0 g/m$^2$ for the yellow color forming heat-sensitive recording layer, 2.5 g/m$^2$ for the light transmittance-adjusting layer, and 1.2 g/m$^2$ for the protective layer, respectively, formed in this order on the support.

Example 2

The multicolor heat-sensitive recording material (2) of the present invention was prepared in the same manner as in Example 1 except that when forming the back coat layer, the coating solution for the intermediate back layer and the coating solution for the outermost back layer were applied in this order onto the support in amounts of 9 g/m$^2$ and 1 g/m$^2$, respectively, in terms of solid content after drying.

Comparative Example 1

The multicolor heat-sensitive recording material (3) in this comparative example was prepared in the same manner as in Example 1 except that when forming the back coat layer, the coating solution for the intermediate back layer was not used, and the coating solution for the outermost back layer was applied in an amount of 10 g/m$^2$ in terms of solid content after drying.

Comparative Example 2

The multicolor heat-sensitive recording material (4) in this comparative example was prepared in the same manner as in Example 1 except that when forming the back coat layer, the coating solution for the outermost back layer was not used, and the coating solution for the intermediate back layer was applied in an amount of 10 g/m$^2$ in terms of solid content after drying.

(Evaluation of Curling)

The multicolor heat-sensitive recording materials (1) and (2) and the multicolor heat-sensitive recording materials (3) and (4) produced by the Comparative Examples were evaluated in the following manner. The evaluation results are shown in Table 1 below.

Under the environmental conditions (a) and (b) shown below, each A6 size sheet-shaped heat-sensitive recording material was printed in solid gray using a Fujix Digital Color Printer NC300D (Fuji Photo Film Co., Ltd.). Six hours after printing, the curling of each heat-sensitive recording material sheet placed on a plane (that is, average warpage [mm] from said plane at the four corners of the recording material) was measured and regarded as an indicator of curling.

The measured value expressed as "+" refers to a height when the recording material was bent up at the side of the support on which the heat-sensitive recording layer was arranged (front), while the value expressed as "−" refers to a height when the material was bent up at the side on which the back coat layer was arranged (back). Environmental conditions (a): 23° C., 50% RH Environmental conditions (b): 23° C., 20% RH

TABLE 1

| | Heat-sensitive recording material | Back coat layer | | Curling [mm] | |
|---|---|---|---|---|---|
| | | Outermost back layer | Intermediate back layer | 23° C. 50% RH | 23° C. 20% RH |
| Example 1 | (1) | contains synthetic mica | contains No synthetic mica | −2 | 0 |
| Example 2 | (2) | contains synthetic mica | contains no synthetic mica | −4 | +5 |
| Comparative Example 1 | (3) | contains synthetic mica | | −9 | +8 |
| Comparative Example 2 | (4) | contains no synthetic mica | | −9 | +12 |

From the results summarized in Table 1 above, the heat-sensitive recording materials (1) and (2) comprising a back coat layer consisting of two layers whose outermost layer contained an inorganic lamellar compound could prevent deformation (curling) of the material without suffering any influence of environmental humidity.

On the other hand, the heat-sensitive recording materials (3) and (4) whose back coat layer consisted of a single layer suffered serious deformation after printing and could not sufficiently prevent curling, regardless of whether the inorganic lamellar compound was present or not in the back coat layer.

Example 3

(1) Preparation of the Heat-Sensitive Recording Material

The multicolor heat-sensitive recording material (5) of the present invention was prepared in the same manner as in Example 1 except that the back coat layer was formed as described below.

(2) Formation of the Back Coat Layer

—Preparation of a Coating Solution for the Outermost Back Layer—

17 parts of 2% aqueous 2-ethylhexyl sulfosuccinate (RABIZOL B90, Nippon Oil and Fats Co., Ltd.), 19 parts of a synthetic mica dispersion (SOMASHIF MEB-3, Corp Chemical Co., Ltd.) and 41 parts of water were added to 100 parts of 15% aqueous polyvinyl alcohol solution (PVA105, Kuraray Co., Ltd.) and then stirred to give a coating solution for the outermost back layer containing synthetic mica and polyvinyl alcohol.

—Formation of the Back Coat Layers—

The back coat layers were formed in the same manner as in Example 1 except that the respective coating solutions were applied in amounts of 9 g/m$^2$ and 1.2 g/m$^2$, respectively, in terms of solid content after drying.

Example 4

The multicolor heat-sensitive recording material (6) was prepared in the same manner as in Example 3 except that when forming the back coat layer, carbonyl-modified polyvinyl alcohol (KL-118 produced by Kuraray Co., Ltd.) was used in place of polyvinyl alcohol.

Example 5

The multicolor heat-sensitive recording material (7) was prepared in the same manner as in Example 3 except that when forming the back coat layer, the synthetic mica dispersion was not used, and the coating solution for the outermost back layer was applied in an amount of 1.2 g/m$^2$ in terms of solid content after drying.

Comparative Example 3

The multicolor heat-sensitive recording material (8) was prepared in the same manner as in Example 3 except that when forming the back coat layer, the coating solution for the outermost back layer was not used, but the coating solution for the intermediate back layer used in Example 1 was applied in an amount of 10.2 g/m$^2$ in terms of solid content after drying.

(Evaluation of Curling)

The multicolor heat-sensitive recording materials (5) to (8) obtained as above were evaluated in the following manner. The evaluation results are shown in Table 2 below.

Under the environmental conditions of 23° C. and 20% RH, each A6 size sheet-shaped heat-sensitive recording material was printed in solid gray using a Fujix Digital Color Printer NC370D (Fuji Photo Film Co., Ltd.). Just after printing as well as 1 day after printing, the curling of each heat-sensitive recording material sheet placed on a plane (that is, average warpage [mm] from said plane at the four corners of the recording material) was measured and regarded as an indicator of curling.

The measured value expressed as "+" refers to a height when the recording material was bent up at the side of the support on which the heat-sensitive recording layer was arranged (front), while the value expressed as "−" refers to a height when the material was bent up at the side on which the back coat layer was arranged (back).

TABLE 2

| | Heat-sensitive recording material | Back coat layer | | | | Curling | |
|---|---|---|---|---|---|---|---|
| | | Outermost back layer | | Intermediate back layer | | | 1 day |
| | | Synthetic mica | Binder | Synthetic mica | Binder | Just after printing | after printing |
| Example 3 | (5) | Present | PVA | absent | gelatin | −16 | 12 |
| Example 4 | (6) | Present | modified PVA | absent | gelatin | −16 | 13 |
| Example 5 | (7) | Absent | PVA | absent | gelatin | −26 | 13 |
| Comparative Example 3 | (8) | Only 1 layer (no synthetic mica; binder = gelatin) | | | | −30 | 19 |

From the results summarized in Table 2, the heat-sensitive recording material (7) comprising a back coat layer consisting of two layers whose outermost layer contained polyvinyl alcohol could prevent deformation of the material just after printing under the conditions of low humidity. The heat-sensitive recording materials (5) and (6) comprising the back coat layer consisting of two layers whose outermost layer contained an inorganic lamellar compound (synthetic mica) and polyvinyl alcohol could prevent deformation (curling) of the material just after printing and also 1 day after printing in the low-humidity environment.

On the other hand, the heat-sensitive recording material (8) whose outermost layer did not contain polyvinyl alcohol suffered serious deformation of the material just after printing and also 1 day after printing and could not sufficiently prevent curling.

As described above, the present invention can provide a high-quality multicolor heat-sensitive recording material essentially comprising a sheet material and multiple layers, which can prevent curling attributed to an environmental change or heating during recording, is free of deformation of the material, and is applicable to a wide variety of fields.

What is claimed is:

1. A heat-sensitive recording material having at least a heat-sensitive recording layer on one side of a support and a back coat layer on the other side, wherein the back coat layer comprises a plurality of layers, and an outermost layer in the back coat layer, which is most remote from the support, contains at least one of an inorganic lamellar compound and polyvinyl alcohol, and an intermediate back layer positioned between the support and the outermost layer comprises a water-soluble binder and has a different composition from the outermost layer.

2. The heat-sensitive recording material according to claim 1, wherein thickness of the outermost layer is 0.3 to 6 $\mu$m.

3. The heat-sensitive recording material according to claim 1, wherein total thickness of the rest of the plurality of layers, positioned between the support and the outermost layer, is 2 to 15 $\mu$m.

4. The heat-sensitive recording material according to claim 1, wherein the heat-sensitive recording layer comprises a recording layer containing an electron-donating dye precursor and an electron-accepting compound capable of reacting with said electron-donating dye precursor to develop color, and a recording layer containing a diazonium salt compound and a coupler capable of reacting with said diazonium salt compound to develop color.

5. The heat-sensitive recording material according to claim 1, wherein the support is a paper support laminated with polyethylene on at least one side thereof.

6. A heat-sensitive recording material having at least a heat-sensitive recording layer on one side of a support and a back coat layer on the other side, wherein the back coat layer comprises a plurality of layers, and an outermost layer in the back coat layer, which is most remote from the support, contains an inorganic lamellar compound, and an intermediate back layer positioned between the support and the outermost layer comprises a water-soluble binder and has a different composition from the outermost layer.

7. The heat-sensitive recording material according to claim 6, wherein the inorganic lamellar compound has an average particle longer diameter of 0.3 to 20 $\mu$m.

8. The heat-sensitive recording material according to claim 6, wherein the outermost layer further contains gelatin.

9. The heat-sensitive recording material according to claim 8, wherein the amount of the inorganic lamellar compound to be contained is 1 to 100 parts by mass relative to 100 parts by mass of the gelatin.

10. The heat-sensitive recording material according to claim 8, wherein the inorganic lamellar compound is water-swelling synthetic mica.

11. The heat-sensitive recording material according to claim 10, wherein the synthetic mica has an aspect ratio of at least 100.

12. A heat-sensitive recording material having at least a heat-sensitive recording layer on one side of a support and a back coat layer on the other side, wherein the back coat layer comprises a plurality of layers, and an outermost layer in the back coat layer, which is most remote from the support, contains polyvinyl alcohol, and an intermediate back layer positioned between the support and the outermost layer comprises a water-soluble binder and has a different composition from the outermost layer.

13. The heat-sensitive recording material according to claim 12, wherein an application amount of the polyvinyl alcohol is 0.3 to 5.3 g/m$^3$.

14. The heat-sensitive recording material according to claim 12, wherein degree of saponification of the polyvinyl alcohol is at least 88%.

15. The heat-sensitive recording material according to claim 12, wherein the outermost layer further contains an inorganic lamellar compound.

16. The heat-sensitive recording material according to claim 15, wherein the amount of the inorganic lamellar compound to be contained is 3 to 30 parts by mass relative to 100 parts by mass of the polyvinyl alcohol.

17. The heat-sensitive recording material according to claim 15, wherein the inorganic lamellar compound is synthetic mica.

18. The heat-sensitive recording material according to claim 17, wherein the synthetic mica has an aspect ratio of at least 100.

19. The heat-sensitive recording material according to claim 12, wherein the intermediate back layer contains gelatin.

* * * * *